US009161649B2

(12) United States Patent
Rastegar

(10) Patent No.: US 9,161,649 B2
(45) Date of Patent: Oct. 20, 2015

(54) ELECTRONIC CURTAIN MOVING DEVICE

(71) Applicant: Hossein Rastegar, Mission Viejo, CA (US)

(72) Inventor: Hossein Rastegar, Mission Viejo, CA (US)

( * ) Notice: Subject to any disclaimer, the term of this patent is extended or adjusted under 35 U.S.C. 154(b) by 67 days.

(21) Appl. No.: 13/926,664

(22) Filed: Jun. 25, 2013

(65) Prior Publication Data

US 2014/0008028 A1 Jan. 9, 2014

(30) Foreign Application Priority Data

Jul. 3, 2012 (IR) ..... 13915014000302684

(51) Int. Cl.
*A47H 5/032* (2006.01)
*A47H 11/06* (2006.01)
*E06B 9/322* (2006.01)

(52) U.S. Cl.
CPC ..... *A47H 5/0325* (2013.01); *A47H 11/06* (2013.01); *E06B 9/322* (2013.01)

(58) Field of Classification Search
USPC ..... 160/331, 320, 168.1 P
See application file for complete search history.

(56) References Cited

U.S. PATENT DOCUMENTS 1,831,128 A * 11/1931 McKenny et al. ..... 160/331
2,043,981 A * 6/1936 Bickel ..... 160/126
2,468,453 A 4/1949 Bernar
2,788,481 A 4/1957 Lui et al.
2,798,194 A * 7/1957 Cantin ..... 318/266
3,003,552 A 10/1961 Eilenberger
3,096,078 A * 7/1963 Steingass et al. ..... 254/273
3,117,767 A * 1/1964 McLean et al. ..... 254/362
3,269,454 A 8/1966 Gill et al.
3,438,423 A * 4/1969 Melull et al. ..... 160/331
3,561,520 A 2/1971 Gill
3,620,284 A * 11/1971 Charles et al. ..... 160/11
4,031,944 A 6/1977 Morrison et al.
4,481,998 A * 11/1984 Strandberg et al. ..... 160/344
4,548,250 A * 10/1985 Meharg et al. ..... 160/331
4,610,294 A 9/1986 Anesi et al.
4,775,039 A 10/1988 Sunakawa
4,819,708 A * 4/1989 Onosato et al. ..... 160/331
4,914,360 A * 4/1990 Hsieh et al. ..... 318/16
4,956,588 A * 9/1990 Ming ..... 318/16
4,958,112 A 9/1990 Zerillo
5,270,629 A * 12/1993 Hsieh ..... 318/600

(Continued)

FOREIGN PATENT DOCUMENTS

GB 2282525 A 4/1995
JP 3125782 A 5/1991

OTHER PUBLICATIONS

Robotshop Distribution Inc., Remote Controlled Drapery and Vertical Blind Motor (http://www.robotshop.com/add-a-motor-drapery-controller-80Orc-1), 2003-2013.

*Primary Examiner* — Katherine Mitchell
*Assistant Examiner* — Justin Rephann

(57) ABSTRACT

Provided is an electronic curtain moving device. Thus device can comprise: a pulley operably connected to a motor, the pulley having a groove through which a cord of a curtain travels, wherein the pulley can move in clockwise and counter-clockwise directions; a head capable of movement from a first and a second position; Wherein movement of the pulley in the clockwise direction makes the head move to the first position and make contact with the cord, and movement of the pulley in the counter-clockwise direction makes the head move to the second position and make contact with the cord at a different location than contact at the first position.

7 Claims, 11 Drawing Sheets

(56) References Cited

U.S. PATENT DOCUMENTS

| | | | | | |
|---|---|---|---|---|---|
| 5,598,000 | A * | 1/1997 | Popat | 250/206 |
| 5,752,558 | A * | 5/1998 | Lin | 160/320 |
| 5,829,198 | A * | 11/1998 | Watanabe | 49/280 |
| 5,889,377 | A | 3/1999 | Mao | |
| 5,913,563 | A * | 6/1999 | Watanabe et al. | 296/155 |
| 5,930,954 | A * | 8/1999 | Hebda | 49/345 |
| 6,144,177 | A * | 11/2000 | Mao | 318/466 |
| 6,463,986 | B1 | 10/2002 | Gouda | |
| 6,598,652 | B1 | 7/2003 | Montesinos Alonso | |
| 6,724,164 | B2 * | 4/2004 | Shimizu et al. | 318/282 |
| 7,337,825 | B1 * | 3/2008 | Erbe et al. | 160/331 |
| 7,360,576 | B2 * | 4/2008 | Lin | 160/331 |
| 7,510,146 | B2 * | 3/2009 | Golden | 244/129.3 |
| 7,548,037 | B2 * | 6/2009 | Boisvert et al. | 318/466 |
| 7,977,904 | B2 * | 7/2011 | Berman et al. | 318/480 |
| 8,033,374 | B2 * | 10/2011 | Gunton | 192/224 |
| 2005/0239588 | A1 | 10/2005 | Lin | |
| 2005/0252620 | A1 * | 11/2005 | Lin | 160/168.1 P |
| 2009/0254222 | A1 * | 10/2009 | Berman et al. | 700/275 |
| 2009/0272035 | A1 * | 11/2009 | Boisvert et al. | 49/28 |
| 2011/0220299 | A1 * | 9/2011 | Berman et al. | 160/5 |
| 2012/0285086 | A1 * | 11/2012 | Boisvert et al. | 49/25 |
| 2013/0199735 | A1 * | 8/2013 | Colson et al. | 160/2 |

* cited by examiner

ELECTRONIC CURTAIN MOVING DEVICE

CROSS-REFERENCE

The present application claims the benefit of Iranian Patent Application No. 13915014000302684 filed on Jul. 3, 2012, and issued on Aug. 22, 2012, under Registration No. 76439, whose content is incorporated herein by reference in its entirety.

BACKGROUND SECTION OF THE INVENTION

There is generally a need for moving curtains automatically without manual effort. Curtains for example can be heavy, inaccessible and also can be inconvenient to open and close manually.

The art proposes several devices to automatically move curtains. These devices have multiple drawbacks.

First, most of these devices are expensive and need special rods and meant to be installed by a professional with special tools. They also need costly periodical service and maintenance. Second, most of these devices rely on physical means (such as limit switches) to limit the range of travel for the device. A user has to constantly adjust these physical means since limit switches will not be in the correct position in order to operate correctly after a while. In case of obstacle in the traveling course of the curtain rod, these devices cannot stop operation, which will damage curtain, curtain rod and the device itself. Third, the art lacks a device that can adjust itself automatically overtime as the cord of the curtain loses its length integrity and stretches with each day passing, resulting in loss of tight grip needed between cord and pulley for consistence operation.

Fourth, the devices of the art can be noisy, lack intelligence, rely on materials for the cord of a curtain that are expensive, and prone to break, and be difficult to install and operate.

There is a need in the art for a device for electronically and intelligently moving a curtain without the drawbacks present in the art.

SUMMARY SECTION OF THE INVENTION

In one embodiment, provided is an electronic device for movement of a curtain comprising: a. a pulley operably connected to a motor, the pulley having a groove through which a cord of a curtain travels, wherein the pulley can move in clockwise and counter-clockwise directions; b. a head capable of movement from a first and a second position; wherein movement of the pulley in the clockwise direction makes the head move to the first position and make contact with the cord, and movement of the pulley in the counter-clockwise direction makes the head move to the second position and make contact with the cord at a different location than contacting at the first position. The head is operably connected to a motor separate from the motor of the pulley. The pulley has a V shaped groove for placement of the cord and the groove of the pulley has a textured plastic coating that creates a non-uniform surface. The weight of the device is supported by the cord, allowing the device to move downward in the event that the cord stretches overtime, providing a tight connection between the pulley and the cord all the time. The device is placed in a rail system attached to the wall that limits the movement of the device in lateral and upward direction. The device comprises first and second sections which pivotally attached to each other, wherein the first section pivots clockwise and counter-clockwise in relation to the second section in direction of movement of the pulley to allow for contacting between the head and the cord. The device determines the position of beginning and ending of the curtain rod based on the amperage that the main motor which is attached to the pulley uses. The device can terminate operation of pulling the cord when the main motor amperage exceeds a predetermined level. The device upon termination of the operation can allow free movement of the main motor which is attached to the pulley, this free movement resulting in release of tension existing in the cord. The predetermined level of amperage, which is used by the main motor, indicates full open or full closed positions of the curtain. This predetermined level of amperage can also indicate an obstacle in the traveling course of the curtain. The device can measure amperage of the main motor a plurality of times every second. The device can self-program its action based on prior use. The device can open or close the curtain randomly to provide an impression that a person is opening or closing the curtain. The device can close the curtain in direct sun light. The device can be remotely controlled. The device can automatically pull the cord to fully open or fully close the curtain based on pre-set time of day.

In one embodiment, provided is a method for operating or closing a curtain comprising using the device as described above.

In one embodiment, provided is an electronic device for movement of a curtain comprising a pulley operably connected to a motor, the pulley having a groove through which a cord of a curtain travels, wherein the pulley can move in clockwise and counter-clockwise directions; wherein weight of the device rests on the cord.

In one embodiment, provided is an electronic and mechanical device for movement of a curtain comprising: a. An operation compartment comprising: i. A pulley operably connected to a first motor, the pulley having a groove through which a cord of a curtain travels, wherein the pulley can move in clockwise and counter-clockwise directions; ii. A head operably connected to a second motor capable of movement from a first and a second position laterally; wherein movement of the pulley in the clockwise direction makes the head move to the first position and make contact with the cord, and movement of the pulley in the counter-clockwise direction makes the head move to the second position and make contact with the cord at a different location than contacting at the first position; b. A control compartment comprising mechanical and electronic hardware for making the head and the pulley work; c. A rail system, in which the operation compartment is placed, this rail system limits lateral or upward movement of the operation compartment; wherein the weight of the device rests on the cord; wherein the first motor has a shaft that creates a pivot point, allowing the control compartment to pivot in relation to the operation compartment, direction of the pivot determined by direction of rotation of the pulley.

DETAILED DESCRIPTION OF THE INVENTION

The present invention provides an electronic curtain moving device (ECMD 1) which is cost effective to manufacture, can be used with any cord driven curtain rod, and can be installed by anyone without any special skills and literally is a DIY(do it yourself) device. The ECMD 1 automatically adjusts itself to the length of the curtain rod and intelligently recognizes the start position and end position of the curtain rod each time it operates, making the ECMD 1 effective and easy to use and requiring no maintenance at all. The device also can be installed in less than five minutes without any special tools.

ECMD 1 can be installed on windows of various lengths: ECMD 1 can be installed on any window of any length and is capable of moving home, hospital, hotel and office curtains of any weight and length.

ECMD 1 is capable of this identification for curtains of various lengths, and can "open" or "shut" or "stop" a curtain at any point along the curtain rod. ECMD 1 can work with any cord driven curtain rods. There is no need to replace or obtain a special curtain rod.

ECMD 1 is made in one embodiment to rest on the cord 4 itself, and as cord 4 stretches, ECMD 1 maintains the necessary tension. ECMD 1 does not require any type of limit switches (other physical means to keep the device functional), which are installed on the curtain rod for recognizing the start position and end position of the curtain rod. In one embodiment, ECMD 1 is made with head 15 that has its own motor and transmission, and touches cord 4 on either side of the head 15 depending on the direction of the movement of the pulley 14.

ECMD 1 can control home, hospital, office and hotel (or other places where the need exists) curtain rods of any size and weight with any working systems (leftward opening, rightward opening, center opening) There is no need for the presence of the user in the place and his/her manual labor for controlling curtain rods. Rather by a momentary pressing of the triple commands switches on the wall or by issuing commands through the remote control unit 12 or by control systems command in the absence of the user, curtains are controlled by ECMD 1 automatically and intelligently, opening or shutting or stopping at their course, where the user intends.

Figure 1A:
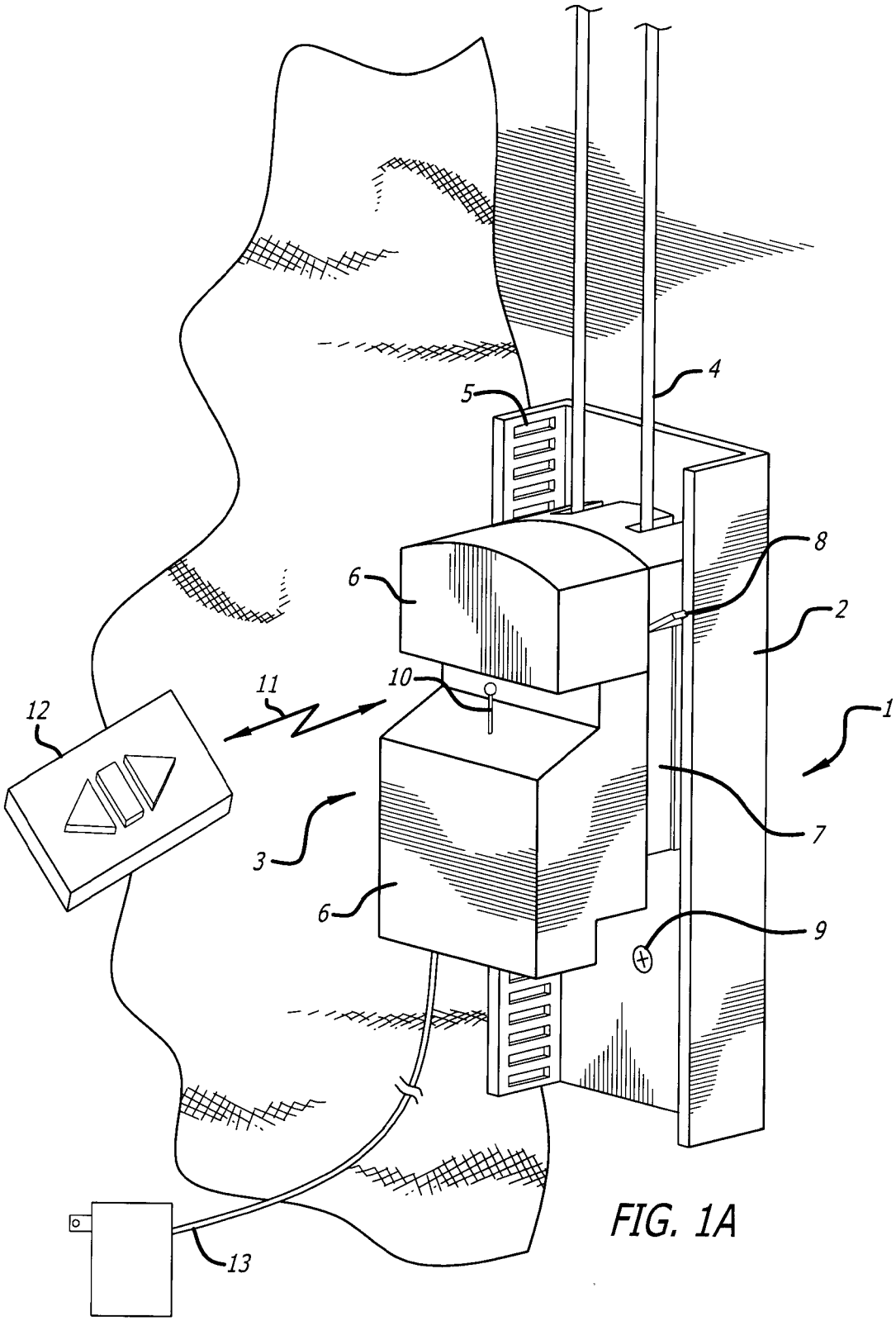
FIG. 1A is an illustration of the electronic curtain moving device in a rail system.

FIG. 1A illustrates the ECMD 1. The operation compartment 7 can sit in a rail system 2. The rail system 2 is attached to the wall with screws 9. The rail system 2 has a plurality of holes 5 for the blades 8 to move in and out. The device which is put in the rail system 2 is a one piece device that has two main compartments. Control compartment 6 and operation compartment 7 are pivotally attached to the each other. Control compartment 6 contains all the components that do not physically contact the cord 4, including head motor 16 and main motor 17, transmission 18 and electronic equipment 19. Cord 4 can be made of any material that can wrap around the pulley 14 and be moved by the pulley 14. Metallic, natural and synthetic non-metallic material can be used. In one embodiment, a non-metallic synthetic material such as polyester is used. The material has flexibility and be somewhat stretchable without tearing. This material is suitable for holding the weight of ECMD 1. Control Compartment 6 has an antenna 10 or other receivers for receiving information from remote control 12. Control Compartment 6 has an electronic connection 13 to a source of power. Operation compartment 7 includes blades 8.

Figure 1B:
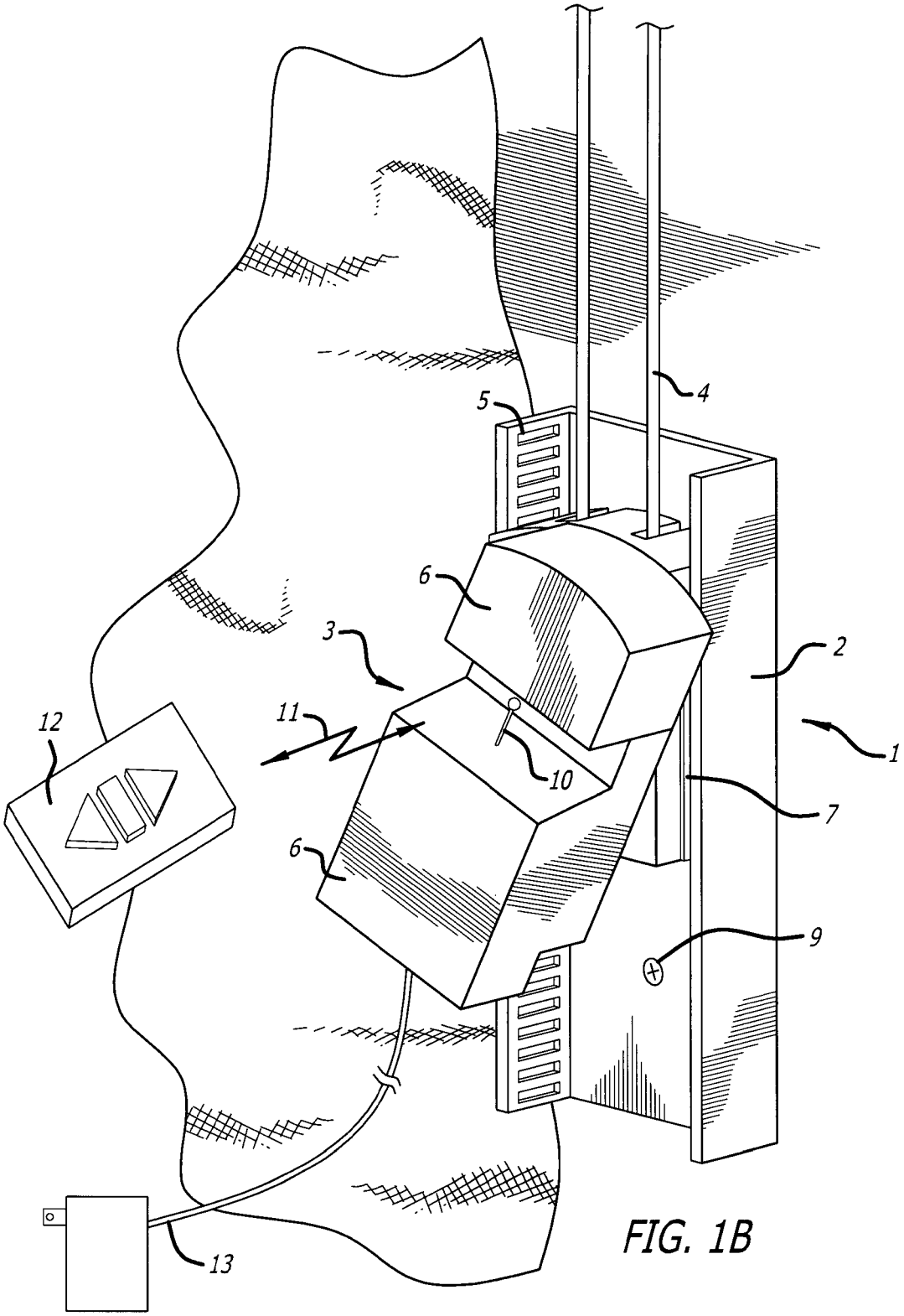
FIG. 1B is an illustration of the electronic curtain moving device in a pivoted position.

FIG. 1B is the same figure as FIG. 1A except that the device is in use and control compartment 6 has pivoted 30 degrees to the right in relation to operation compartment 7. If the device is used to pull the cord 4 in the opposite direction, the device would also pivot 30 degrees in the opposite direction. When the V shaped pulley 14 of the main motor 17 starts to pull, the force transfer thread resists against the pull generated at the beginning of the movement, resulting in pivoting of the device. The device can be designed with various degrees of pivoting, such as about 10 to about 40 degrees.

Figure 2:
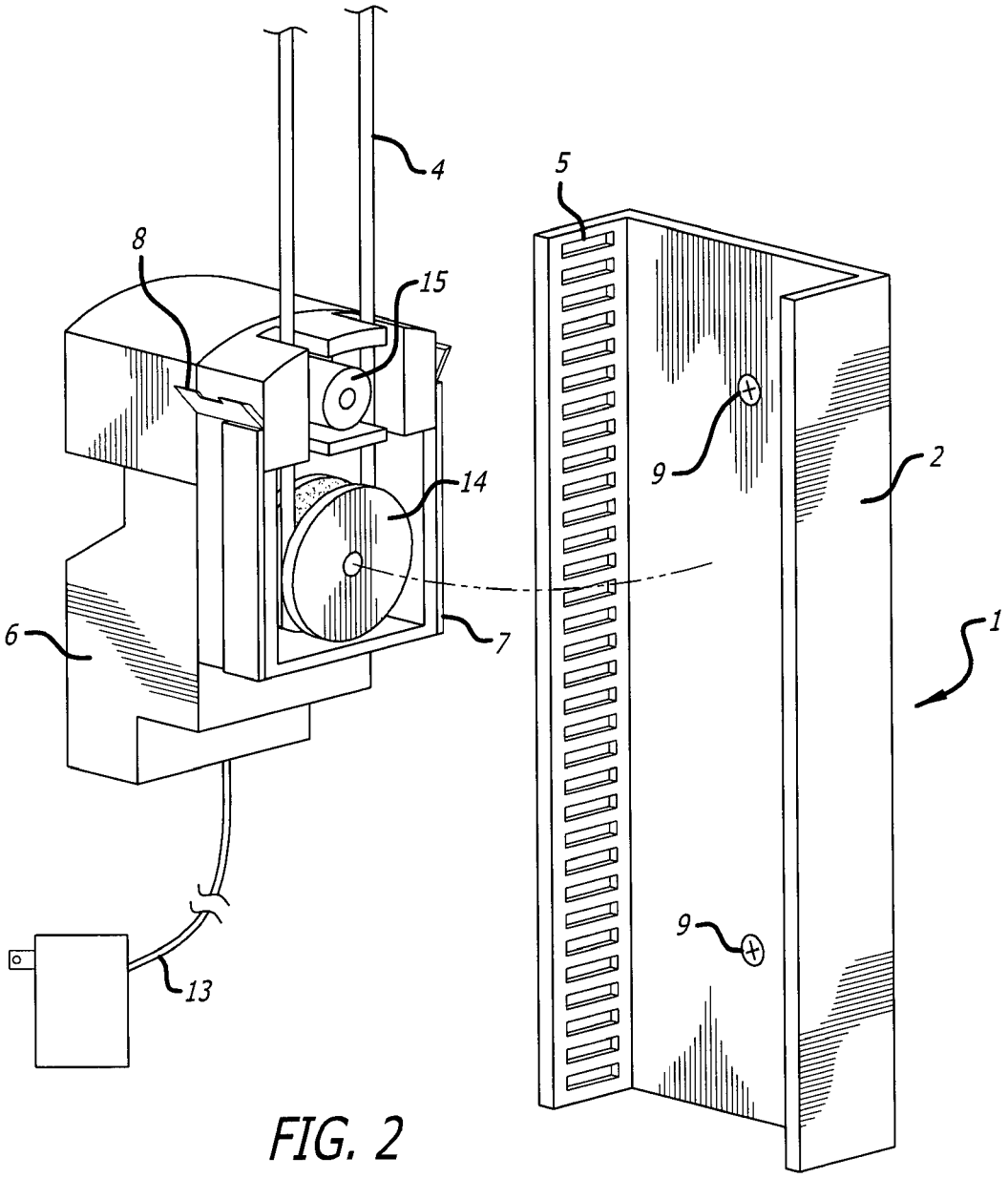
FIG. 2 is an illustration of the electronic curtain moving device outside of the rail system, with the operation compartment illustrated in detail.

FIG. 2 illustrates the details of the operation compartment 7. The pulley 14 and the head 15 are inside the operation compartment 7. Head 15 prevents the cord 4 from coiling around the V shaped pulley 14 which would have locked the main motor 17. The head's 15 function is to swiftly take out that part of the force transfer cord 4 released from the V shaped pulley 14 from inside the operation compartment 7 so to prevent that part of the slackened cord 4 released by the V shaped pulley 14 from recoiling around that pulley 14 due to friction with the inner wall of said pulley 14, and impeding its movement and locking it. Cord 4 wraps around groove 49 of pulley 14. The cord 4 passes on both sides of head 15. Blades 8 are attached to the operation compartment 7. Control compartment 6 is pivotally attached to the operation compartment 7. Operation compartment 7 is placed in the rail system 2, which is attached to the wall through screws 9. The interaction of blades 8 and holes 5 limit upward movement (Upward Auto Lock System) of the operation compartment 7. To remove the operation compartment 7 from the rail system 2, blades 8 can be unlocked. Rail system 2 also limits lateral movement of the operation compartment 7.

Figure 3:
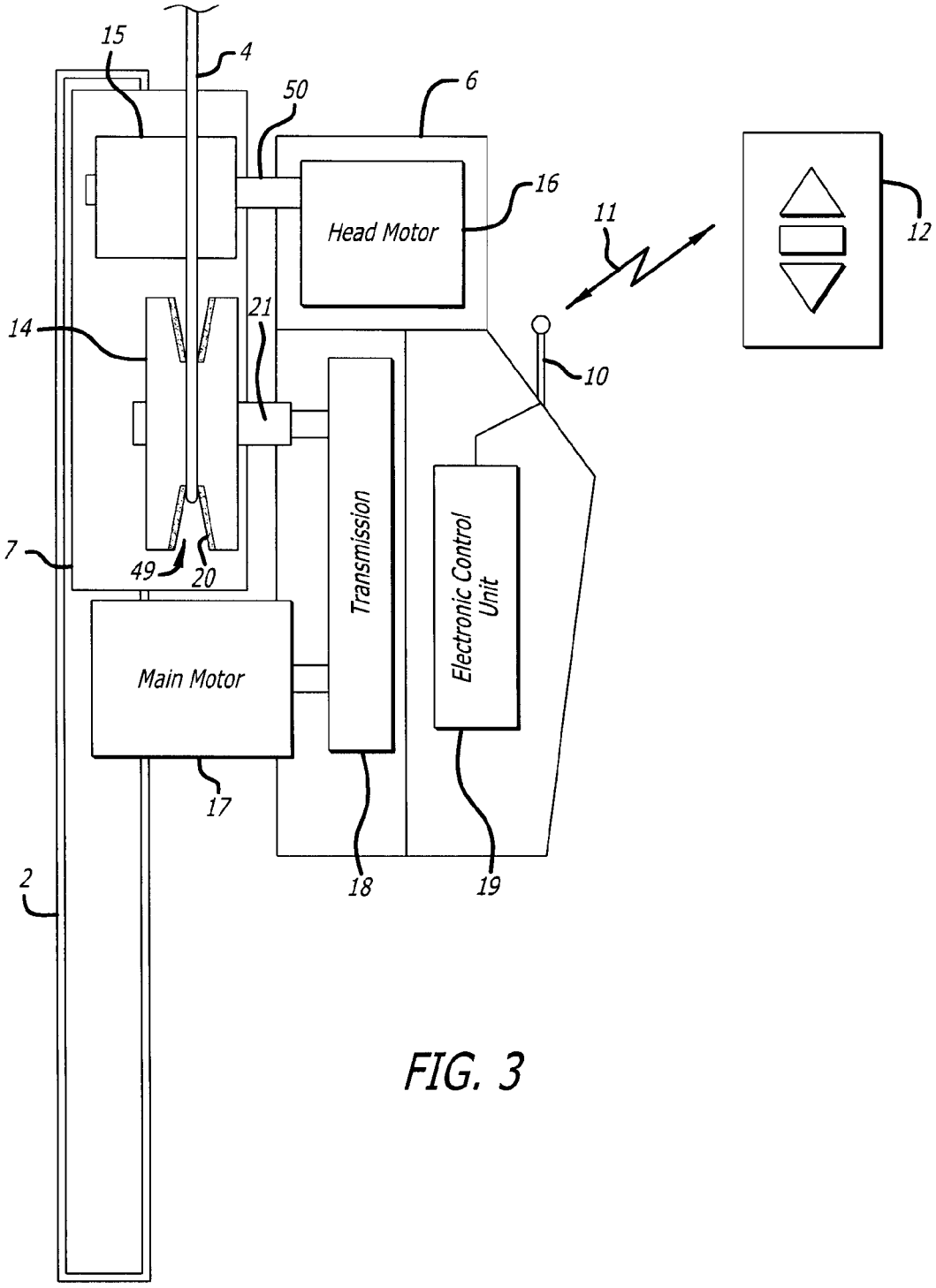
FIG. 3 is a side view of the electronic curtain moving device.

FIG. 3 illustrates a side view of the device. The control compartment 6 houses the head motor 16 (which includes a transmission that is not illustrated). The control compartment 6 also houses the electronic control unit 19, and antenna 10 capable of receiving electronic communication 11 from the remote control 12. The control compartment 6 houses the transmission 18 that operably connects the pulley 14 with the main motor 17. The main motor 17 is shown in FIG. 2 is extending away from the control compartment 6 and attached to the transmission 18 which is located in the control compartment 6.

Operation compartment 7 is shown with pulley 14 and head 15. Operation compartment 7 is placed inside the rail system 2. The pulley 14 has a V shaped groove 49 and coating 20 for increasing friction on the pulley 14. The coating 20 is made of an Ultra-high-molecular-weight polyethylene (UHMWPE, UHMW). The coating 20 provides a durable abrasion resistant, textured and non-skid finish. The cord 4 wraps around pulley 14. There are two connections between the operation compartment 7 and control compartment 6. One connection is shaft 21, which connects transmission 18 and pulley 14. Shaft 21 is the point where the device pivots. The shaft 21 has three functions: a) Connecting the control compartment 6 to the operation compartment 7; b) Transferring force from the transmission 18 in the control compartment 6 to the V shaped pulley 14, which is installed in the operation compartment 7; c) Rotating the control compartment 6 around (its own axis) shaft 21, 30 degrees left and right in relation to the operation compartment 7 at the start of the motion of the main motor 17 (due to the curtain rod movement control thread resisting at the beginning of the pull).

The second connection is shaft 50, connecting head motor 16 to head 15. An opening (cut in the housing) 51 in the operation compartment 7 allows shaft 50 to move laterally, to allow for pivoting of the control compartment 6 in relation to the operation compartment 7.

Figure 4:
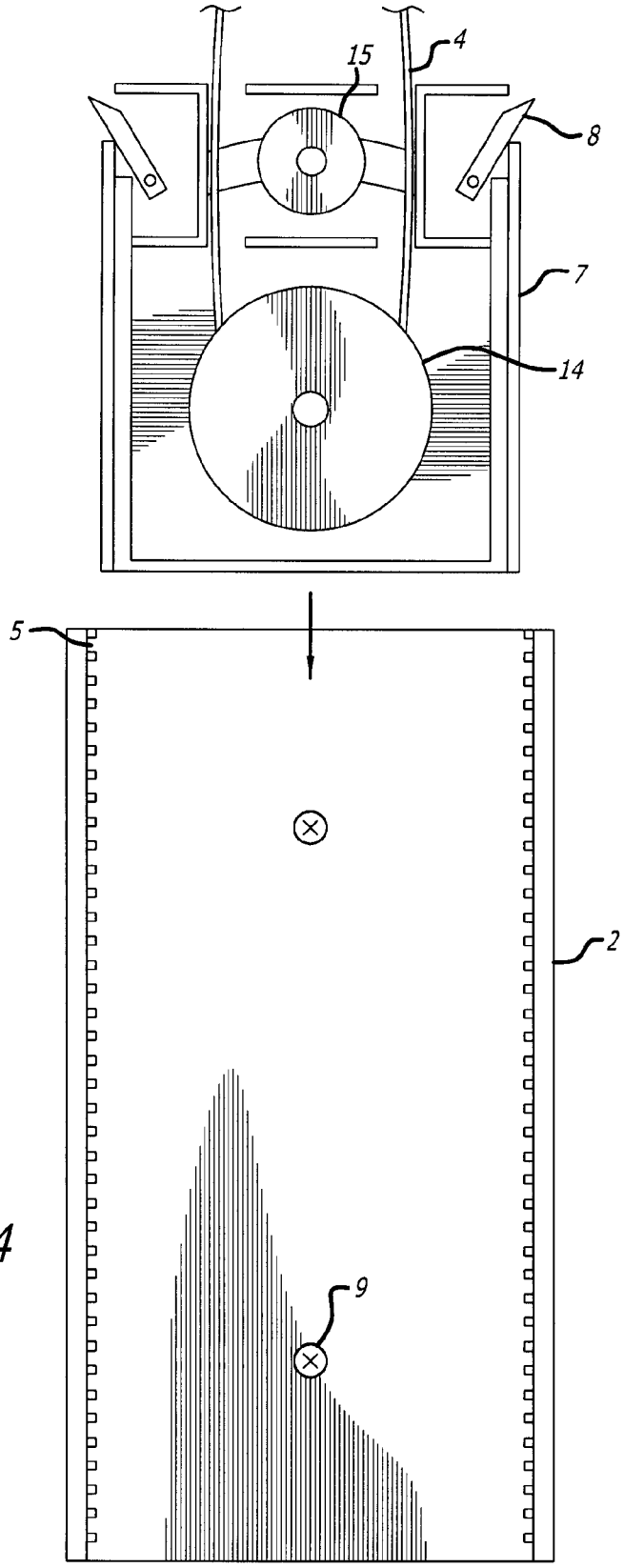
FIG. 4 is an illustration of the electronic curtain moving device outside of the rail system, with the operation compartment illustrated in detail.

FIG. 4 illustrates operation compartment 7 before it is placed in the rail system 2. Cord 4 has wrapped around pulley 14, and travels on each side of head 15. Blades 8 limit upward movement of the operation compartment 7 by fitting into the holes 5. Rail system 2 is attached to the wall through screws 9.

Figure 5:
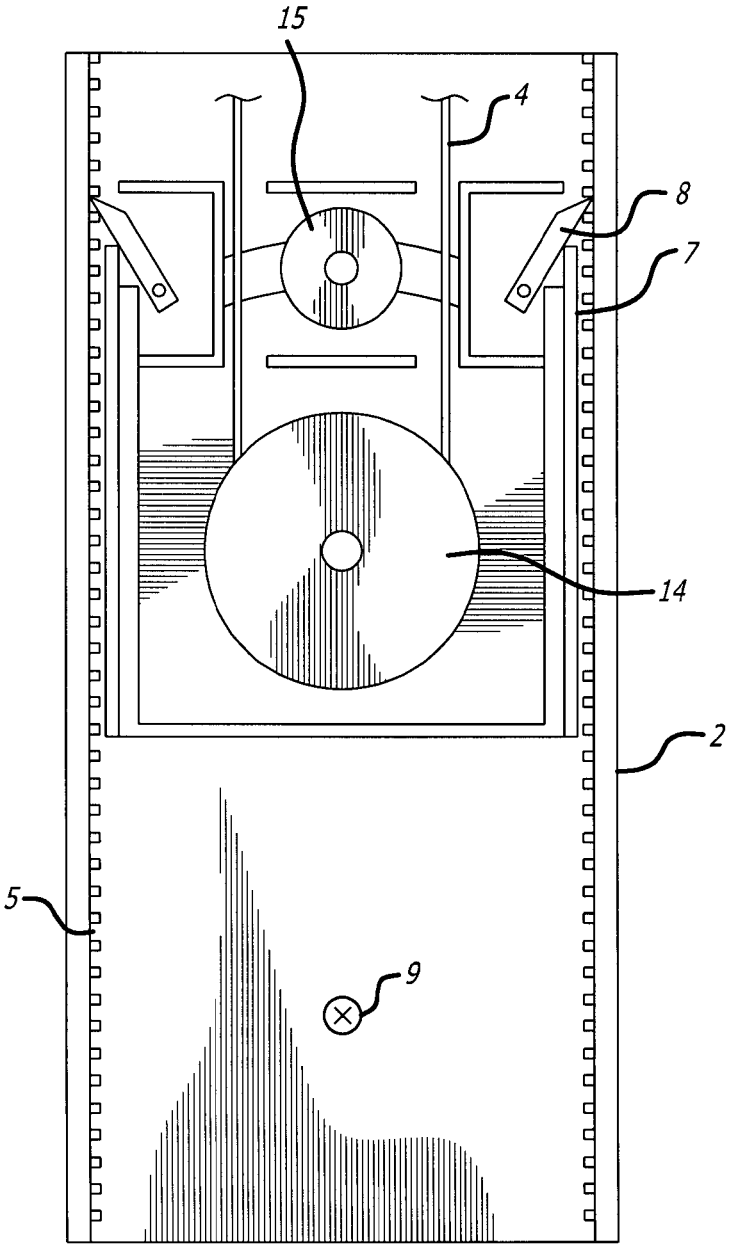
FIG. 5 is an illustration of the electronic curtain moving device inside of the rail system, with the operation compartment illustrated in detail.

FIG. 5 is the same illustration as FIG. 4 except that the operation compartment 7 is now placed in the rail system 2. Blades 8 interact with the rail system 2, and allow only for downward movement of the operation compartment 7. The walls of the rail system 2 also limit lateral movement of the operation compartment 7. Operation compartment 7 which is put in the rail system 2, is now supported by cord 4, otherwise ECMD 1 would fall down.

Figure 6:
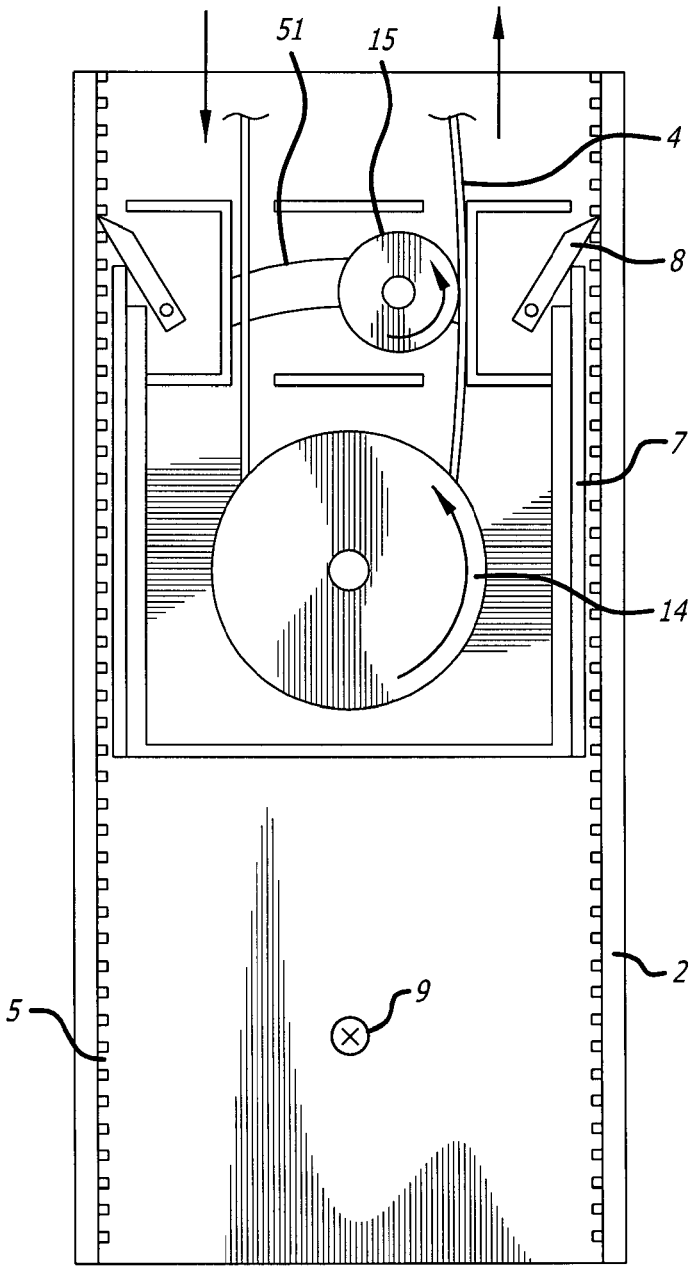
FIG. 6 is an illustration of the electronic curtain moving device inside of the rail system, with the pulley moving in counter-clockwise direction.
Figure 7:
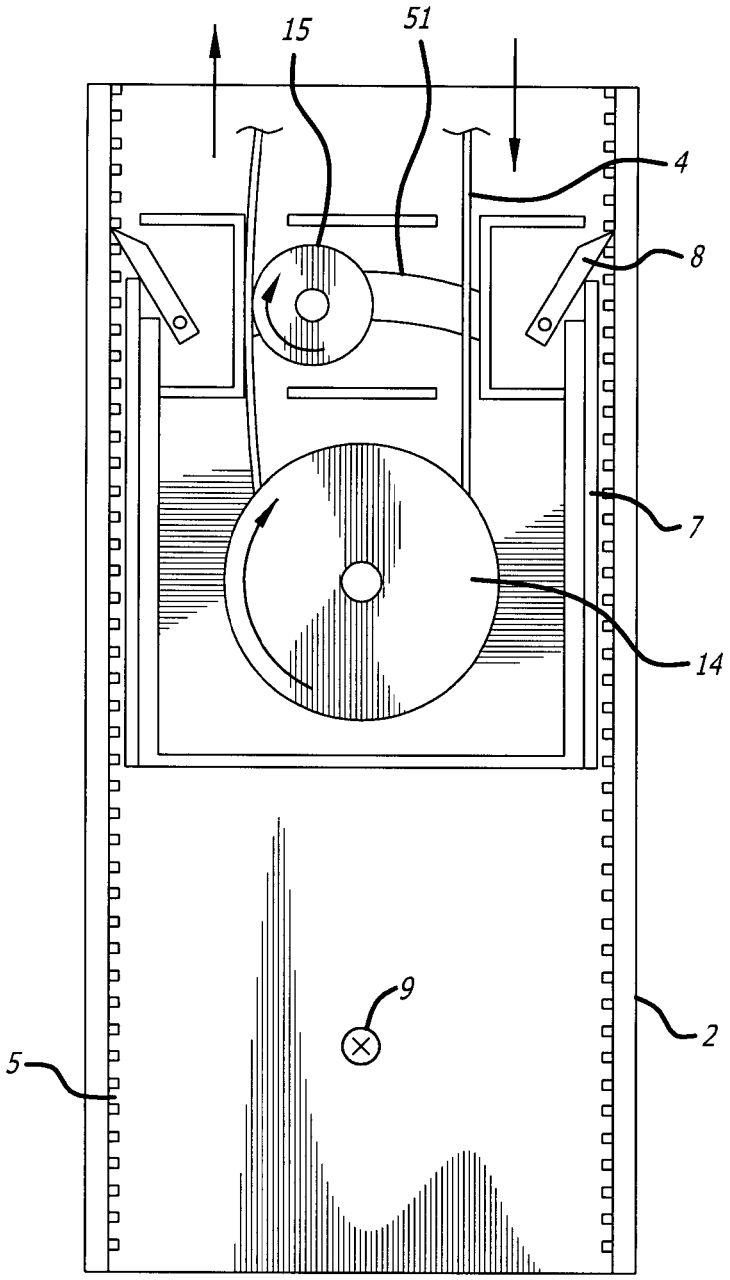
FIG. 7 is an illustration of the electronic curtain moving device inside of the rail system, with the pulley moving in a clockwise direction.

FIG. 6 is the same illustration as FIG. 5 except that the ECMD 1 is now operating. The pulley 14 is pulling cord 4 in counter-clockwise fashion. The force generated by the pulley 14 at the start point of operation has made the head 15 move to the right side and contact cord 4. FIG. 7 is the same illustration as FIG. 6 except that the pulley 14 is travelling in clockwise fashion, and has made the head 15 move to the left side. Control compartment 6 (not shown in these figures) would pivot left and right in each of these figures.

Figure 8:
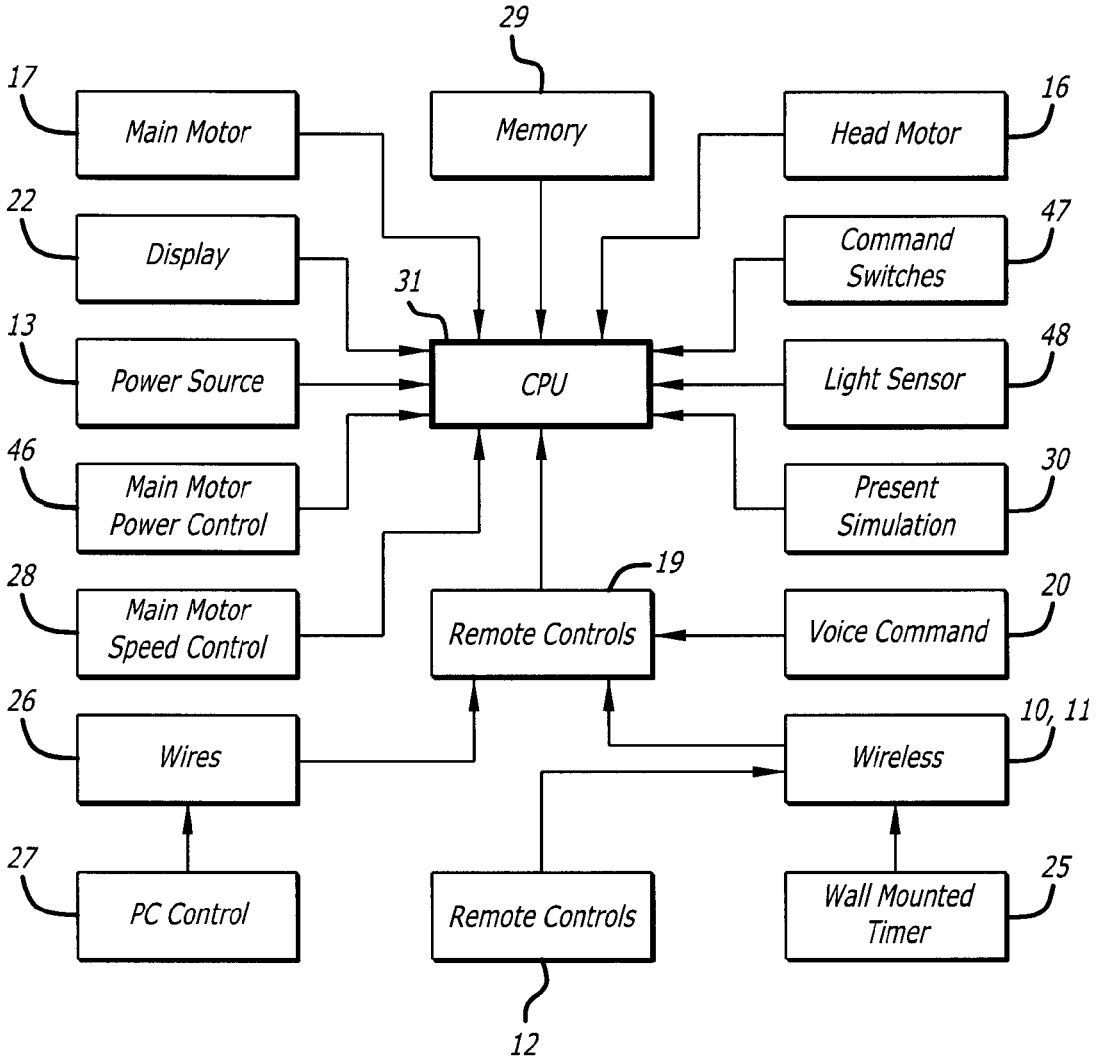
FIG. 8 is an illustration of the electronic map of the electronic curtain moving device.

FIG. 8 illustrates an electronic map of ECMD 1. Various components are in electronic communication with CPU 31. A user may interact with the ECMD 1 with various remote controls 19. These controls can include wired controls 26 such as a personal computer 27 (P.C.). Wired controls 26 are ideal for places with a plurality of rooms, such as hotels. There can also be wireless controls 11, wherein a remote control 12 or a wall mounted timer 25 can be used. The ECMD 1 includes a memory 29 (such as a flash memory), power source 13, power control 46, command switches 47, head motor 16 and main motor 17, voice command 20, present simulation 30, light sensor 48, and display 22.

Electronic components can include a) An amperage electronic control system for automatically and intelligently stopping the curtain at the start position or end position, b) A remote control system which is equipped with rolling code and also three different radio channels for issuing the triple commands: open, shut, and stop. This remote control system is capable of modulating commands on "new passwords" in each transmission by using its rolling code system, c) An "RS-485" Telecommunication System for establishing a united network of devices which could also be controlled by a P.C. (personal computer). This system is applicable in hotels, hospitals, residential complexes or offices, d) A triple-command of "open", "shut" and "stop" system on the Control compartment 6, e) An input portal for connecting to the intelligent control systems such as various sensors and receiving their commands, f) An input portal for connecting to the cable of triple-command wall switches, g) An input portal for connecting to the telecommunication system "RS-485", h) An eightfold deep switch for giving address to each ECMD 1 in binary codes and exclusive manner, i) An input portal for 24V, 3 Ampere feed, j) A triple power control key for exerting three power statuses of the main motor 17 for light, medium and heavy weight curtains, k) A key for determining motors' rotation for leading the correct direction of rotation when the loop of the curtain rod movement control thread is being installed inside the V shaped pulley's groove 49, 1) A reset key for resetting all electronic systems of the ECMD 1, m) A "learning" key of the remote control for the remote module, n) An activation key for the intelligent learning system; comprehending and exerting of the user's action on the control compartment 6.

Figure 9:
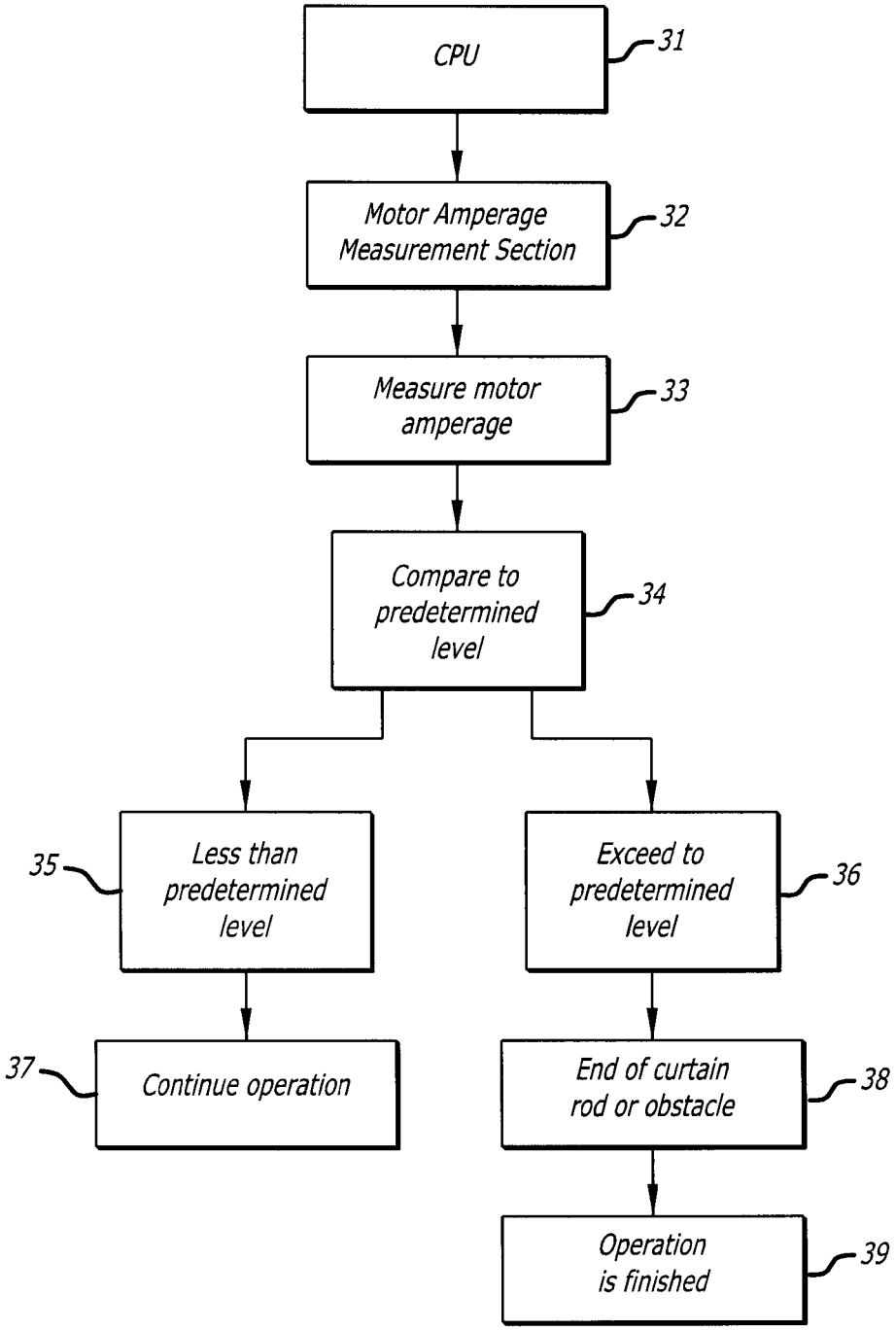
FIG. 9 is a flow chart illustrating a program for controlling the movement of curtain and acting based on amperage of the motor.

FIG. 9 is a flow chart illustrating how the device is programmed to function. When the amperage hits a predetermined level 34, the main motor 17 and head motor 16 are stopped to put the curtain in a proper position (fully opened or fully closed). The motor amperage measurement section 32 that is in the electronic communication with the CPU 31 constantly measures motor amperage 33 and compares the measured amperage to a predetermined level 34. If the measured amperage is less than the predetermined level 35, the operation 37 (pulling of curtain cord) is continued. If the measured amperage exceeds to predetermined level 36, either the ending_or beginning points of the curtain rod or an obstacle 38, the operation of the main motor 17 and head motor 16 is terminated 39 to put the curtain in fully opened position or fully closed position or to stop the curtain immediately to prevent the main motor 17 and head motor 16 and also curtain and curtain rod from damage in case of obstacle 38. In one embodiment, when the amperage of main motor 17 increases and passes from 900 M AMP, the amperage electronic control system comes into play and reduces the input voltage to the main motor 17 and head motor 16 from 24V to 0V. This operation can take place in less than one second so that as soon as the curtain reaches the beginning position or end position of the curtain rod, the related system turns the head motor 16 and main motor 17 off, and stop the curtain. The amperage electronic control system of CPU 31 can monitor the motor's amperage, 10 times per second.

Depending on the amperage of main motor 17 uses, ECMD 1 determines whether an the curtain has hit an obstacle or is at an end or start position. When end of the curtain rod is obtained, ECMD 1 resets its internal memory (if there is an inconsistency) and marks the position as the end of the curtain rod.

Figure 10:
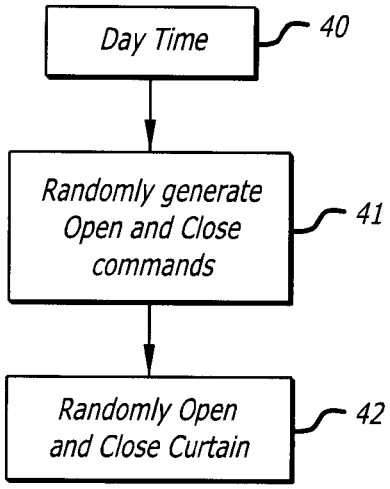
FIG. 10 is a flow chart illustrating a program for randomly opening and closing a curtain.

FIG. 10 illustrates programming the ECMD1 to randomly open and close 42 during daytime 40. The commands are randomly generated 41 by CPU31. This computer implemented program simulates that a person is home and therefore keeps away burglars. ECMD 1 can be also connected to the home alarm system, so that when the alarm is set and the user leaves home, this system is automatically implemented.

Figure 11:
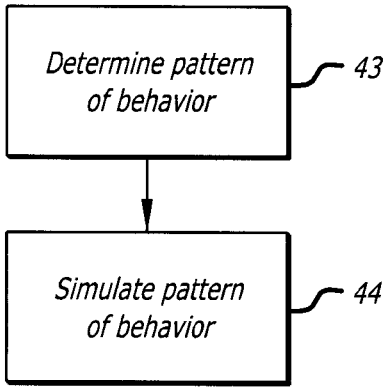
FIG. 11 is a flow chart illustrating a program for simulating a pattern of behavior.

FIG. 11 illustrates programming the ECMD 1 to simulate a user's pattern. The ECMD 1 first determines a pattern of behavior 43. For example, the pattern of behavior is the time a user opens or closes a curtain. The ECMD 1 then simulates the pattern of behavior 44. The ECMD 1 is equipped with a new electronic system called "The intelligent system of learning and comprehending user behavior". When the user activates this system, it monitors the user's behavior in controlling the curtain rod during the first 24 hours and learns this behavior. It observes all commands issued by the user to the ECMD 1 and their times, preserving them in its memory. At the end of the first 24 hours, the system begins to control the curtain rod based on the information it has received from the user during the first 24 hours, so that it issues said commands at their specific times to the electronic control system of the ECMD 1. For instance, if the user has issued the "open" command at 7 AM during the first 24 hours, each day at the same time the "open" command will be automatically issued to the electronic control system of the ECMD 1 so that the curtain will be opened at that specific time automatically. This system is capable of receiving and preserving one hundred "open", "shut" and "stop" commands during the first 24 hours and in the following days, it will issue the same commands at their specific time to the ECMD 1. In case the user does not need this system to control the curtain, it can be deactivated by the related button on the control compartment 6.

Also provided is a method of using the device described herein.

What is claimed is:

1. An electronic device for movement of a curtain comprising:

a. a control compartment;

b. an operation compartment;

c. an automatic rail system;

d. a head system;

e. a main motor; and f. a head motor;

wherein said head system has two main functions:

i. said head system travels from a first position to a second position or vice versa, wherein rotation of a main motor drive shaft in the clockwise direction pulls a control cord of said curtain in the clockwise direction and makes said head system travel to the first position and make contact with said control cord at the first position, and the rotation of said main motor drive shaft in the counter-clockwise direction pulls said control cord of said curtain in the counter-clockwise direction and makes said head system travel to the second position and make contact with said control cord in said second position;

ii. said head system is rotated using a head motor drive shaft which rotates in clockwise and counter-clockwise directions, after contact between said head system and said control cord occurs in said first position the head system is rotated in a clockwise direction to pull the control cord that is in an extended position out of the operation compartment, and after contact between said head system and control cord occurs in said second position the head system is rotated in a counter-clockwise direction which pulls the control cord that is in an extended position out of said operation compartment; wherein when said main motor drive shaft rotates clockwise said head motor drive shaft rotates clockwise too, and when said main motor drive shaft rotates counter-clockwise, said head motor drive shaft rotates counter-clockwise too.

2. The device of claim 1, wherein said head system is operably connected to said head motor separate from said main motor.

3. The device of claim 1, wherein said operation compartment is placed in said automatic rail system attached to a wall proximate a window therein at an approximate mid-vertical height of said window, which automatically allows movement of said operation compartment downward when said control cord stretches over time providing a tight connection between a pulley and said control cord, and automatically locks said operation compartment which limits said operation compartment from upward movement and lateral movement.

4. The device of claim 1, wherein said control compartment and said operation compartment are pivotally attached to each other, wherein the said control compartment pivots clockwise and counter-clockwise in a direction of a movement of said main motor to facilitate contact between said head system and said control cord.

5. The device of claim 1, wherein when the device reaches a full opened or closed position of the curtain, said main motor, which is connected to said pulley, moves in an opposite direction for 0.5 seconds, the opposite direction movement results in a release of tension existing in said control cord.

6. An electronic device for movement of a curtain comprising:

a) an operation compartment comprising:

i) a pulley operably connected to a first motor, the pulley having a groove through which a cord of a curtain travels, wherein the pulley can move in clockwise and counter-clockwise directions;

ii) a head operably connected to a second motor capable of movement from a first and a second position; wherein movement of the pulley in the clockwise direction makes the head move to the first position and make contact with the cord, and movement of the pulley in the counter-clockwise direction makes the head move to the second position and make contact with the cord at a different location than contact at the first position;

b) a control compartment comprising mechanical and electronic hardware for making the head and the pulley work;

wherein the operation compartment is placed in a rail system that limits lateral or upward movement of the operation compartment;

wherein a weight of greater than 1 pound, associated with a total weight of the device rests on the cord;

wherein the first motor has a shaft that creates a pivot point, allowing the control compartment to pivot in relation to the operation compartment, direction of the pivot determined by direction of rotation of the pulley.

7. An electronic device for movement of a curtain comprising:

a. an operation compartment comprising:

i. a main motor with a main motor drive shaft connected to a pulley through which a control cord of a curtain travels wherein said main motor drive shaft rotates in clockwise and counter-clockwise directions;

ii. a head motor is connected to a head system through a head motor drive shaft, wherein said head system has two primary functions;

1. said head system moves from a first position and a second position wherein the rotation of said main motor drive shaft in the clockwise direction makes said head system move to a first position and make contact with said control cord at said first position, and rotation of said main motor drive shaft in the counter-clockwise direction makes said head system move to said second position and make contact with said control cord at said second position; and 2. the said head system is connected to said head motor drive shaft of said head motor which rotates in clockwise and counter-clockwise directions, wherein after said head system and said control cord make contact with one another at either the first position or second position the rotation of said head motor drive shaft pulls the control cord that is in an extended position out of said operation compartment, wherein when said main motor drive shaft rotates clockwise, said head motor drive shaft rotates clockwise too, and when said main motor drive shaft rotates counter-clockwise said head motor drive shaft rotates counter-clockwise too;

b. a control compartment comprising:

i. mechanical hardware; and ii. electronic hardware;

wherein said mechanical hardware and said electronic hardware make said head system and said main motor work, c. an automatic rail system wherein the said operation compartment is placed in said automatic rail system attached to a wall proximate a window therein at an approximate mid-vertical height of said window, which automatically allows the movement of said operation compartment downward when said control cord stretches over time providing a tight connection between said pulley and said control cord and wherein said rail system automatically limits from upward or lateral movement of the operation compartment;

wherein the weight of the device which is 1.65 pounds rests on said control cord; wherein said main motor has a main motor drive shaft that creates a pivot point, allowing said control compartment to pivot in relation to the operation compartment, wherein the direction of the pivot is determined by the direction of the rotation of said main motor drive shaft.

* * * * *